United States Patent [19]

Tank et al.

[11] Patent Number: 4,653,569

[45] Date of Patent: Mar. 31, 1987

[54] PROCESS FOR PRODUCING FIBER-REINFORCED LIGHT-METAL CASTINGS

[75] Inventors: Eggert Tank, Wernau; Dieter Hedrich, Schwaebisch Gmuend; Peter Straub, Fellbach, all of Fed. Rep. of Germany

[73] Assignee: Daimler-Benz Aktiengesellschaft, Fed. Rep. of Germany

[21] Appl. No.: 827,288

[22] Filed: Feb. 7, 1986

[30] Foreign Application Priority Data

Feb. 7, 1985 [DE] Fed. Rep. of Germany ..... 3504118

[51] Int. Cl.[4] ..... B22D 19/14

[52] U.S. Cl. ..... 164/97; 164/119; 164/120; 164/133

[58] Field of Search ..... 164/97, 120, 119, 113, 164/338.1, 108–110, 133

[56] References Cited

U.S. PATENT DOCUMENTS

| | | | |
|---|---|---|---|
| 3,668,748 | 6/1972 | Divecha et al. | 164/97 |
| 4,492,265 | 1/1985 | Donomoto et al. | 164/97 |
| 4,508,158 | 4/1985 | Amateau et al. | 164/97 |
| 4,572,270 | 2/1986 | Funatani et al. | 164/97 |
| 4,586,554 | 5/1986 | Tank et al. | 164/97 |

*Primary Examiner*—Nicholas P. Godici
*Assistant Examiner*—Samuel M. Heinrich
*Attorney, Agent, or Firm*—Barnes & Thornburg

[57] ABSTRACT

A process is described for producing fiber-reinforced light-metal castings in which a loose fiber tangle is placed in a casting mold and is saturated with molten light-metal under low pressure. Subsequently, the excess of molten light-metal is squeezed off while the fiber tangle is compressed. The outflow of the molten light-metal is then stopped with the molten light-metal being solidified under high pressure. The process is especially suitable for utilizing the solution-spun inorganic fiber tangles that up to now had not been especially suitable for the reinforcing of light-metals.

13 Claims, 5 Drawing Figures

PROCESS FOR PRODUCING FIBER-REINFORCED LIGHT-METAL CASTINGS

BACKGROUND AND SUMMARY OF THE INVENTION

This invention relates generally to a process for producing fiber-reinforced light-metal castings, and in particular, to a process in which a loose fiber tangle is placed in a casting mold, saturated with a molten light-metal under low pressure and then solidified under high pressure.

Fiber-reinforced light-metal castings, especially those that are reinforced with inorganic fibers, are of increasing interest because they combine the good characteristics of both materials. In German Patent DE-PS No. 26 44 272, the production of such castings takes place by filling a casting mold containing a reinforcing insert of an inorganic fiber material with a molten light-metal, and subsequently solidifying the molten metal mixture under high pressure.

Previously, long fibers or filaments have generally been used for this purpose. However, the disadvantage of these fibers is their extremely high price which in practice prohibits the wide use of castings that are reinforced by means of these long fibers.

Less expensive ceramic fibers are also known. Described in a simplified manner, their manufacturing process includes an inorganic or organic solution that is capable of being spun or a suspension that is capable of being spun, which is made from basic fiber components in an inorganic or organic suspension agent. This liquid is spun into a precursor thread. The thread is then fired into an oxide-ceramic thread with a very small grain size. Although this manufacturing process results in fibers which are very inexpensive, they have the disadvantage that they occur as undirected loose wadding or wool. The loose wadding or wool has only a very low fiber ratio per unit of volume, and the individual fibers are completely undirected in the wool or wadding so that no preferred direction exists. Since some of the fibers have bends as a result of the firing process, their further processing into directed short-fiber webs, as is common, for example, in the case of short carbon fibers, is practically impossible. They can, therefore, be only used as wadding. Although the use of this wadding for the reinforcement of light-metal castings is possible, the wadding must be compressed into a fibrous shaped body, since the fiber ratio per volume in the wadding is too low. This is only possible according to previously contemplated arrangements when the wadding is mixed with a very high content of temporarily or permanently effective binding agents. These binding agents, however, have many disadvantages associated with them. Additionally, the compressed fiber packing offers to the entering metal a high resistance so that the manufacturing of completely saturated non-porous light-metal castings is extremely difficult and is only possible with relatively high reject rates.

It is, therefore, an object of this invention to provide a process for the production of fiber-reinforced castings which have a high fiber ratio, but can nevertheless be made from a loose fiber wadding or wool with a low fiber ratio per unit of volume.

The above and other objects are attained by a process which provides for producing fiber-reinforced light metal castings by saturating a fiber material with a molten light-metal under low pressure, and then solidifying the molten light-metal under high pressure. The process includes saturating a fiber tangle formed of solution-spun, fired, inorganic loose fibers, and then removing the excess of the molten light-metal at the same time the fiber tangle is compressed. The outflow of the molten light-metal is then stopped and the fiber-interspersed light-metal is solidified.

In an especially preferred embodiment of the invention, it is provided that a process includes placing a tangle of fibers formed of loose wadding or loose wool in a casting mold. In another preferred embodiment, a very loose fibrous shaped body containing a very little amount of binding agent may be placed in the mold. Shaped fiber bodies of this latter type are very simple and inexpensive to make, for example, according to the techniques that are common in the fire-proof industry. Thus, a shaped body can be punched out of a light felt plate, a light fiber body or similar object which is desired and suitable for being placed in the mold.

In order to ensure a constant fiber ratio in the light-metal castings of a preferred-embodiment, a quantity of fibers is placed in the casting mold that weighs the same in each case. The simplest way to achieve this is to use the already above-mentioned loose compressed shaped bodies. An advantageous feature of this embodiment is to close the mold tightly at the lateral walls with the shaped body. By means of this frictional engagement at the lateral walls, the probability that the fibers are pressed out of the mold becomes very low. In another preferred embodiment, temporary retaining means are provided, such as screen plates, wire inserts and similar objects, which can prevent possible movement of the fibers and, if necessary, may remain in the finished light-metal casting.

In especially preferred embodiments of the invention, after the required amount of tangled fiber is placed in the casting mold, the fiber tangle is saturated under low pressure with a molten light-metal. This saturating may take place according to known techniques, for example, according to the low-pressure casting process. Since the fiber tangle is very loose, it offers very little resistance to the molten light-metal, and also lets trapped air or gases escape easily. As a result, a temporary retaining means for the fiber tangle in the mold is generally not required. The low delivery pressure of a low-pressure casting facility (below 1 bar) is sufficient for the saturating. This may take place relatively slowly so that the lowest pressure is sufficient. Since the hot light-metal mass is much larger than the fiber mass, the fiber mass does not cool the light metal during the filling. The light metal, therefore, does not solidify in the fiber tangle during saturation. By means of a suitable insulation of the lateral walls of the mold or by heating, it is also ensured that the flowing light metal solidifies in a delayed manner at the lateral walls.

As soon as the mold contains an excess of liquid light-metal, this excess is squeezed off again while the fiber tangle is compressed at the same time according to an advantageous aspect of preferred embodiments of the present invention. As the fiber tangle is compressed, the volume of the cast body decreases. In a preferred embodiment, magnesium is used as the light-metal because it wets the fibers without difficulty, the fibers preferably consisting of aluminum-oxide, mullite, or mixtures thereof. Other preferred embodiments include fibers formed of aluminum borosilicate. Oxide ceramic fibers of the above compositions have high $Al_2O_3$ content and low $SiO_2$ content, resulting in the excess light-metal being removed without difficulty by squeezing off. During the squeezing-off, the excess is advantageously permitted to flow back through the feed opening into a storage container. The low delivery pressure that was used for the saturating of the fiber tangle may in this case continue to exist or it may be removed. The fiber tangle offers little resistance during the compression, and can be easily compressed to relatively high densities.

As soon as the fiber tangle is compressed to the desired density while removing the excess molten light-metal, the further discharge of the molten light-metal is stopped. The mold pressure is now increased to high values resulting in the solidification of the molten light-metal. It is advantageous for the quality of the casting to solidify the melting in a directed way according to especially preferred embodiments. This may take place by a targeted cooling or other measures which are known. By means of the building-up of the high pressure in the solidification phase, the remaining unsaturated hollow spaces between the fibers are also filled, and the solidification shrinkage of the metal is compensated (afterfeed) so that shrinkage cavities will not occur either microscopically or macroscopically. In certain preferred embodiments, this high pressure may be as high as 2000 bars, depending upon the stability of the mold. At the end of the solidification phase, the light-metal casting has the desired measurements and can be removed from the mold.

In certain preferred embodiments of the finished casting, the fiber tangle includes irregular fibers having diameters of between about 2 μm and 5 μm and lengths of generally several centimeters. As a result of the compressing, these fibers receive a clear orientation, namely perpendicular to the compression direction.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
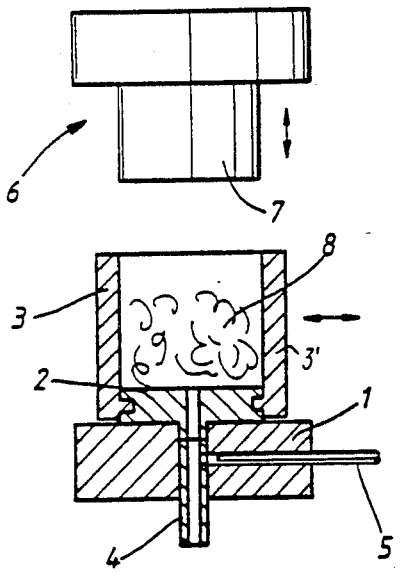
FIG. 1 is a side schematic view of a mold filled with a loose fiber tangle in accordance with a preferred embodiment of the present invention.

FIG. 1, in diagram-form, shows a mold consisting of a mold bottom 2 that is mounted on a bottom plate 1 and two mold walls 3,3' which, in the removal of the finished molded body, can be separated from the mold bottom 2, as schematically shown by the two headed arrow. Additionally included is an upper part 6 of the mold having a male mold 7 attached thereto, that removably fits exactly into the area formed by the mold walls 3,3'.

Figure 2:
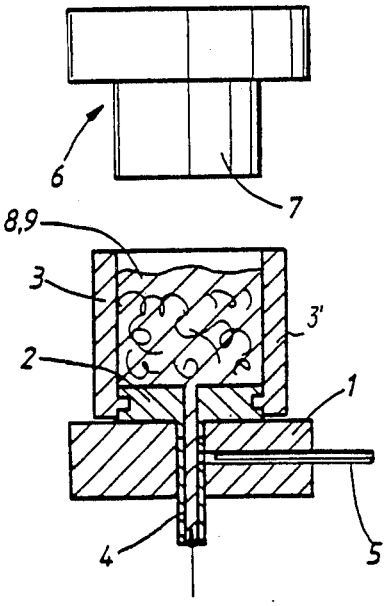
FIG. 2 is a side view of the FIG. 1 arrangement showing the saturating of the loose fiber tangle with the molten light-metal.
Figure 3:
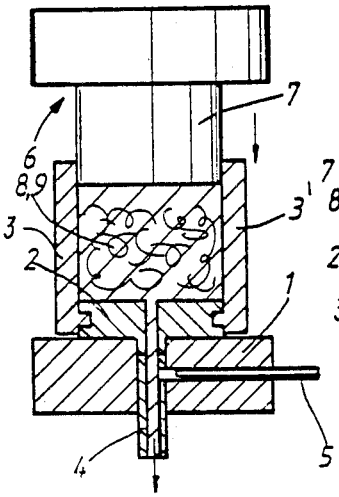
FIG. 3 is a side view of the FIG. 1 arrangement showing the start of the compression and squeeze-off phase.
Figure 4:
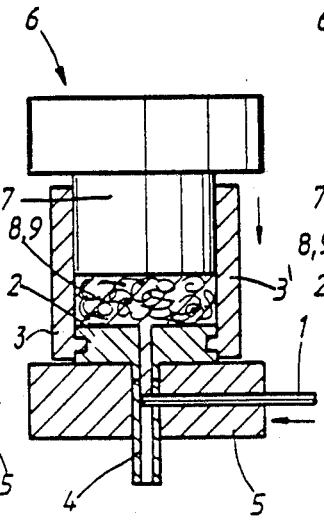
FIG. 4 is a side view of the FIG. 1 arrangement showing the end of the squeeze-off phase and the start of the high-pressure phase.
Figure 5:
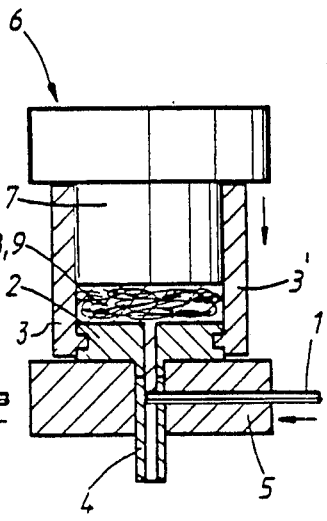
FIG. 5 is a side view of the FIG. 1 arrangement showing the end of the solidification phase under high pressure.

The bottom part of the mold is filled with a loose fiber tangle 8. Subsequently, the mold, as shown in FIG. 2, is filled with the molten light-metal 9 through the ascending pipe 4, thereby saturating the fiber tangle 8. In the bottom plate 1, a slider 5 is mounted by means of which the metal inflow and outflow can be stopped. Subsequently, according to FIG. 3, the male mold 7 is lowered and the excess molten light-metal 9 is squeezed off again while the fiber tangle 8 is compressed at the same time. This squeezing-off should occur rapidly so that no solidification of the molten light-metal 9 takes place in the mold at this point in time. After the excess is squeezed off and the desired degree of density of the fiber tangle 8 is reached, the further outflow of light-metal is stopped by the slider 5 as shown in FIG. 4. However, the pressure of the male mold 7 is maintained so that a high pressure builds up in the molten light-metal. The large mass of the upper part 6 of the mold now causes the solidification of the light-metal 9 from above to below which in a preferred embodiment, is reinforced by an additional cooling of the upper part 6 of the mold. By further maintaining the pressure in the mold, the solidification shrinkage of the metal is continuously compensated so that no shrinkage cavities occur. FIG. 5 shows the end of the solidification phase under high pressure. The casting is now completely solidified in the mold, in which case the volume of the casting is slightly smaller than at the start of the solidification phase according to FIG. 4. After a further cooling, the mold can be opened and the finished light-metal casting can be removed. It should be noted that the figures are only representations of the invention, and therefore, the stroke distances shown are not necessarily the actual stroke distances. Specifically, the strokes shown of the male mold 7 in the compression and solidification phases do not necessarily correspond to the actual stroke sizes.

By means of the process according to the invention, fiber-reinforced light-metal castings can be produced from very inexpensively obtainable solution-spun inorganic loose fibers, in which case these inherently irregularly oriented fibers in the finished casting have a certain orientation. This process is also suitable for all other fibers because the fibers are saturated in a loose condition and are compressed only in the saturated condition. Thus, these fiber-reinforced light-metal castings can be produced having a high fiber content in which a fiber mold packing of the desired fiber density as such would no longer be sufficiently saturable with the light-metal.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A process for producing fiber-reinforced light-metal castings in which a fiber material is saturated with a molten light-metal under low pressure and the molten light-metal is subsequently solidified under high pressure, said process including:

(a) placing a fiber tangle of solution-spun, fired, inorganic loose fibers in a mold;

(b) saturating the fiber tangle with an excess of molten light-metal;

(c) removing the excess of molten light-metal while compressing the fiber tangle at the same time under low pressure;

(d) stopping the outflow of the molten light-metal from the mold; and (e) solidifying the fiber-interspersed molten light-metal under high pressure.

2. A process according to claim 1, wherein the molten light-metal is solidified in a directed manner by a targeted cooling.

3. A process according to claim 1, wherein the molten light-metal is made from magnesium.

4. A process according to claim 3, wherein the fiber tangle is made from a selected group including aluminum-oxide, mullite, aluminum borosiliate and mixtures thereof.

5. A process according to claim 4, wherein the fibers of the fiber tangle are made to have a plurality of diameters having a range of 2 μm to 5 μm.

6. A process according to claim 5, wherein the fibers of the fiber tangle are a length of a few centimeters.

7. A process according to claim 1, wherein removing the excess molten light-metal while compressing the fiber tangle occurs rapidly to prevent solidification of the molten light-metal during this stage.

8. A process according to claim 6, wherein the stopping of the out flow of molten light-metal is done after the desired degree of density of fiber tangle is attained.

9. A process according to claim 1, wherein saturating the fiber tangle takes place relatively slowly at a pressure below one bar.

10. A process according to claim 1, wherein solidifying the fiber-interspersed molten light-metal occurs in a delayed manner at the lateral walls of the mold by means of heating said walls.

11. A process according to claim 1, wherein during the saturating of the fiber tangle a mass of said light-metal is much larger than a mass of said fiber tangle.

12. A process according to claim 1, wherein the high pressure during the solidifying of said fiber-interspersed molten light-metal is greater than 1000 bars.

13. A process according to claim 1, wherein the high pressure during the solidifying of said fiber-interspersed molten light-metal is up to 2000 bars.

* * * * *